United States Patent [19]

Loveland et al.

[11] 4,045,273

[45] Aug. 30, 1977

[54] TAPE CUTTER PROTECTIVE GUARD MEANS FOR CARTON SEALING MACHINE TAPE APPLYING MECHANISM

[76] Inventors: Winton Loveland, 10 Timber Lane, Fort Salonga, N.Y. 11754; Horst J. Hanemann, 175 Aldershot Lane, Manhasset, N.Y. 11030; Saul Warshaw, R.D. No. 1, Box 227, Hawley, Penn. 18428

[21] Appl. No.: 703,213

[22] Filed: July 7, 1976

[51] Int. Cl.[2] ..... B32B 31/00; B26D 5/00; B31B 1/60

[52] U.S. Cl. ..... 156/486; 83/397; 93/36.9; 156/522

[58] Field of Search ..... 156/522, 486, 468; 83/397, 514; 93/36.9

[56] References Cited

U.S. PATENT DOCUMENTS 3,954,550 5/1976 Patterson ..... 156/486

*Primary Examiner*—Douglas J. Drummond

*Attorney, Agent, or Firm*—Watson, Leavenworth, Kelton & Taggart

[57] ABSTRACT

Tape applying mechanism assembly for a carton sealing machine, which includes a movable tape cut-off means or cutter having a cutting edge and guard means protectively covering this cutting edge when the cut-off means is in a projecting idle position. A movable carrier supports tape wipe-on means in a path of advance of a carton when the assembly is mounted in the machine and it is retractable by such carton advance. Additional movable carrier means supports the cutter for motion of its cutting edge across a path of travel of the tape to the advancing carton for severance of the tape as the section of the latter of desired length is applied to the carton. Retractable guard means protectively covers the cutting edge when the cutter is in a projecting idle position intervening successive tape applying actions. Means retract the guard means for uncovering the cutting edge while the carton advances past the tape wipe-on means.

6 Claims, 4 Drawing Figures

TAPE CUTTER PROTECTIVE GUARD MEANS FOR CARTON SEALING MACHINE TAPE APPLYING MECHANISM

BACKGROUND AND SUMMARY

The present invention is concerned with a retractable guard means which temporarily covers protectively the cutting edge of a projecting movable cutter for severing sections from carton sealing tape fed from tape applying mechanism in a carton sealing machine. The tape applying mechanism and movable tape cutter preferably employed in the present invention are disclosed in detail and their actions described at length in the copending patent application of Warshaw et al. Ser. No. 645,718 filed Dec. 31, 1975, and the disclosure thereof is embodied herein by reference.

The retractable guard means covers the cutting edge of the tape cutter only when the latter is in a projecting position. When a carton advances through the machine for application of lengths or sections of the tape which are to be applied for anchoring and sealing infolded bottom and/or top flaps the cutter is uncovered by its guard means. However, when there are no cartons traveling through the machine, so that a tape wipe-on means which is movably supported by a movable carrier and the cutter extend into such carton-free path, such as by projection from the tape applying mechanism assembly whether the latter is mounted in the machine or during removal thereof as well as after the removal, the cutter guard covers the cutter's tape cutting edge so as to avoid injury therefrom, and this guard is automatically moved to such protective position by such projecting movement of these equipment parts.

It is a general object of the present invention to embody such cutter edge guarding means in the tape applying assembly that is relatively simple in construction and economical to install while being reliable in protective function when most needed.

A more specific object of the invention is to assure automatic guard covering of such cutter edge when an operator need to remove any such tape applying assembly for simple replacement of the exhausted supply roll of adhesive tape, so that an inattentive operator will be protected from possible hand injury.

A further object of the invention is to embody with the movable cutter manipulative mechanism which assures automatic movement of the cutter guard to its protective position by the action of a swinging tape wipe-on means, e.g., a roller.

The mechanism of the tape applying assembly as embodied in a carton sealing machine includes a retractable guard means protectively covering the cutting edge of cut-off means or a cutter when the latter is in a projecting idle position. This assembly includes a movable carrier which supports tape wipe-on means, e.g., a roller, that is located in a path of advance of a carton through the machine when this assembly is mounted in the machine, and it will be retractably moved by such carton advance. It also includes additional shiftable carrier means that supports the cutter for moving thereby its cutting edge across a path of travel of the tape to the advancing carton for severance of the tape as the section of the latter of desired length is applied to the carton. This assembly also includes means to retract the guard means for uncovering the cutter's cutting edge while the carton advances past the tape wipe-on means.

The guard means preferably is carried by swinging arm means pivotally supported on frame structure of the tape applying mechanism assembly, and this swinging arm means is suitably linked to the movable carrier which supports the tape wipe-on means. In a preferred embodiment this swinging arm means is in the form of an elongated lever arm of the third class pivotally mounted to the assembly frame structure at one point and carrying the guard means at another point spaced from the pivot point, with the linking means being pivotally connected to this lever arm between these points. The tape wipe-on carrier means preferably is in the form of a pivoted lever arm carrying this tape wipe-on means at its outer end with this lever arm and the guard carrying arm in this embodiment preferably being connected directly together by the linking means. Preferably this linking means is in the form of a single link pivotally connected at spaced points to the guard carrying arm and to the wipe-on arm, with the latter being a lever arm of the first class having its end opposite that carrying the wipe-on means being linked to the guard carrying arm, and with this wipe-on arm being pivotally mounted to the assembly frame structure at a point intermediate this arm's ends. It is also preferred that the manipulative tape cutter means be in the form of a lever arm which carries the cutting edge at one end and is coaxially pivotally and independently mounted at the pivot point of the wipe-on arm to the frame structure while the other end of this cutter arm is connected to the frame structure by resilient biasing means.

Other objects of the invention will in part be obvious and will in part appear from reference to the following detailed description taken in connection with the accompanying drawings, wherein like numerals identify similar parts throughout, and in which.

Figure 1:
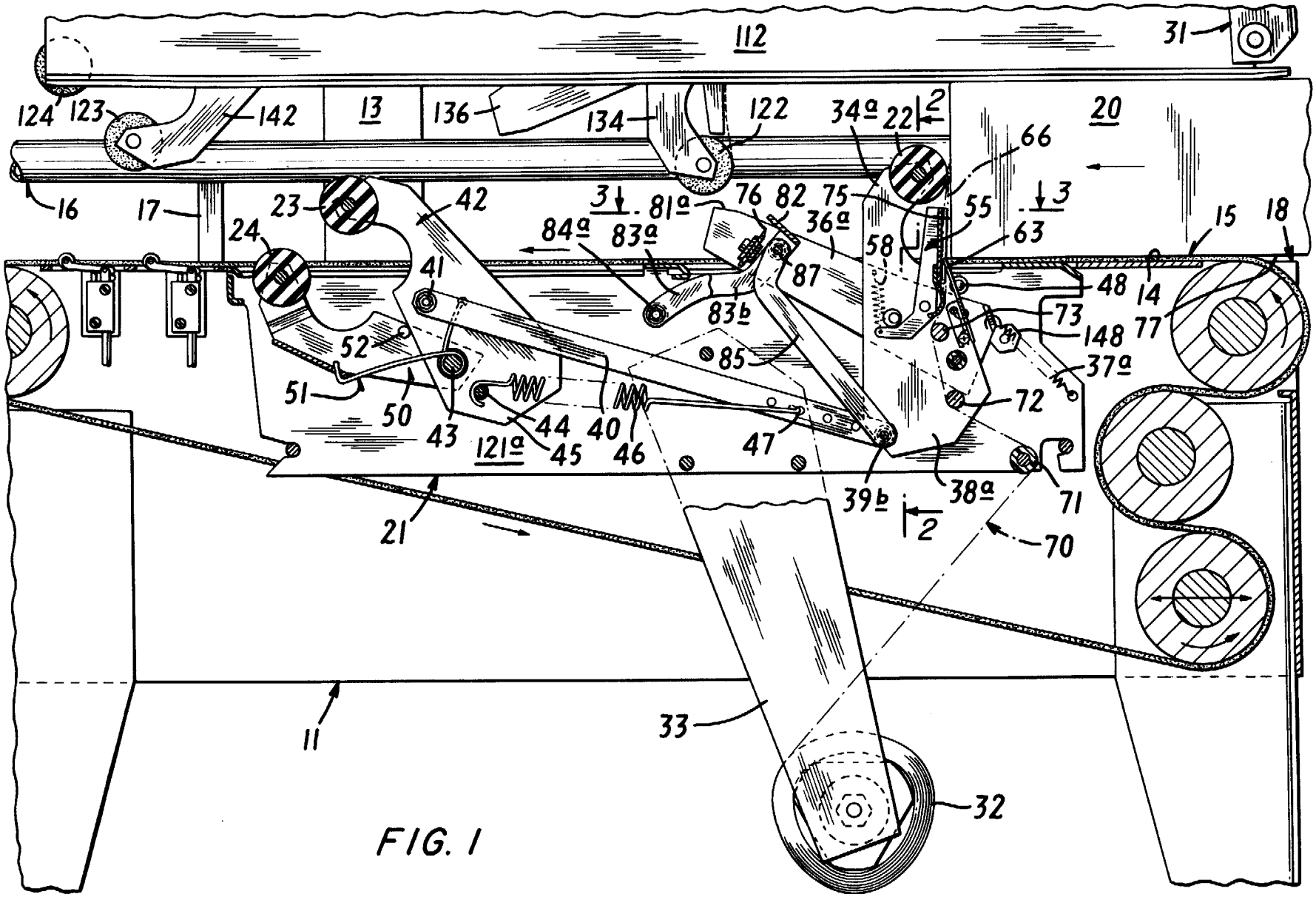
FIG. 1 is a vertical section taken longitudinally of a carton taping machine, with parts broken away, and illustrating a tape-applying assembly unit which is mounted in a longitudinal slot in the top of the base section, showing only portions of an inverted like tape applying assembly unit mounted in the elevating head and of the latter.
Figure 3:
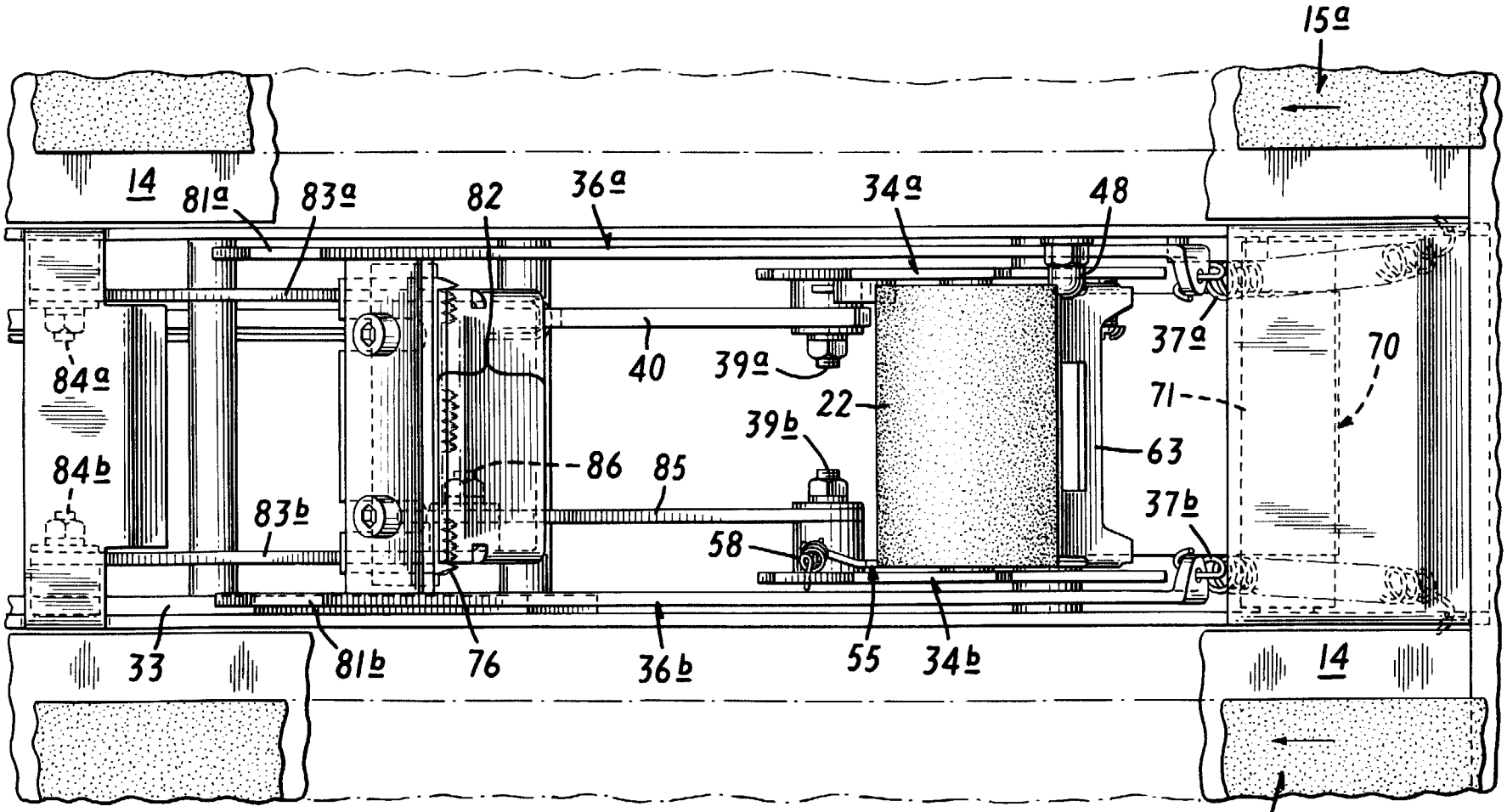
Figure 4:
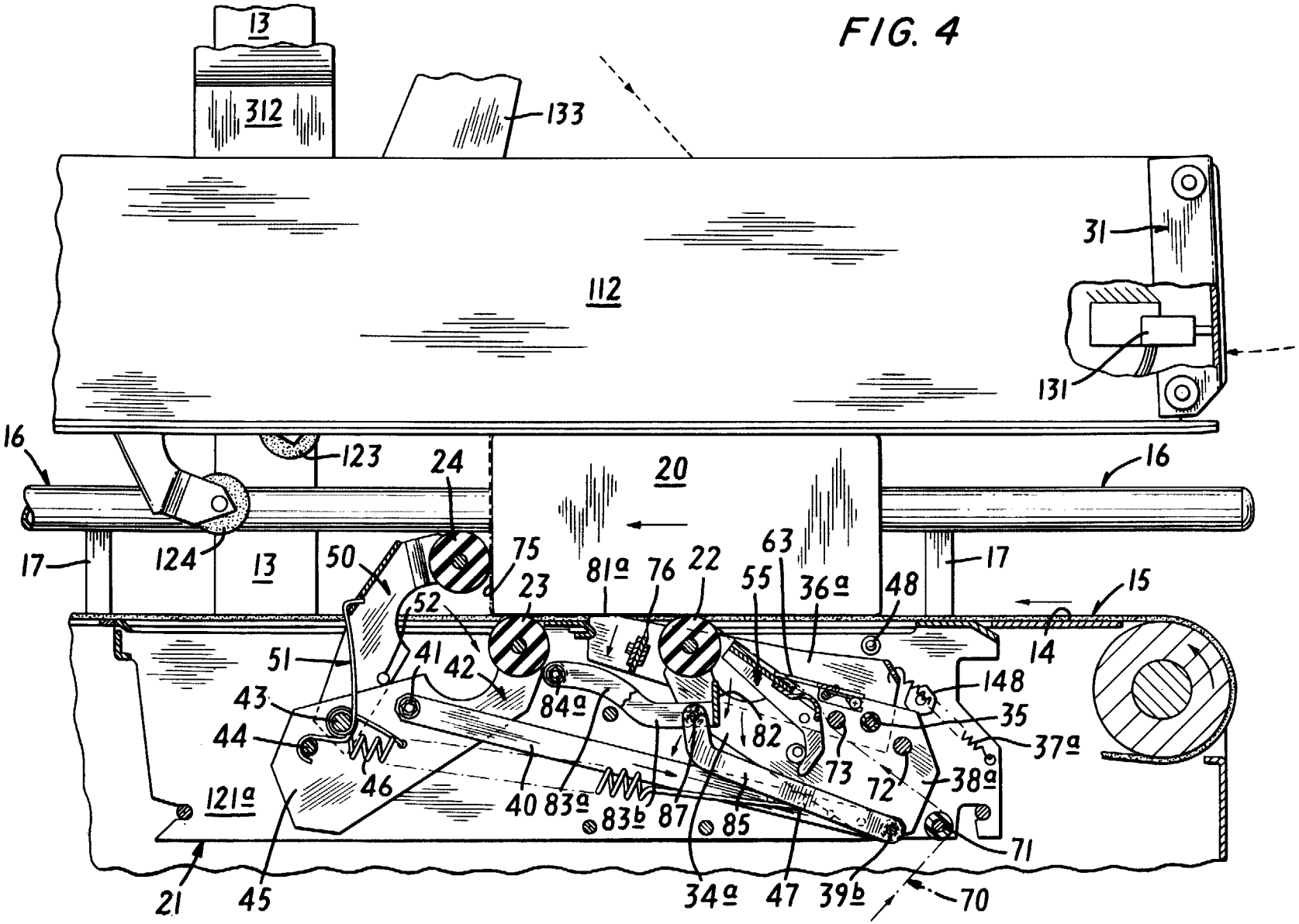

FIG. 3 is a horizontal sectional view, with parts broken away, taken substantially on line 3—3 of FIG. 1; and FIG. 4 is a vertical elevational view of the top portion of the base unit and also of the elevating head beam, with parts broken away and in section, showing the relative positions of the parts of the taping mechanism in the bottom tape applying assembly unit as a carton is advancing thereover for application of a section of the tape to the bottom zones of its leading and trailing end walls and its bottom closure of infolded lapping flaps.

The carton sealing machine which embodies the tape applying mechanism assembly that includes the present invention is more fully illustrated in the precedingly identified patent application Ser. No. 645,718 filed Dec. 31, 1975. It includes a lateral base structure 11 and an elevator head beam structure 112 with the latter supported by a head bracket, adapted for slidable up-and-down movement, on a vertical column 13 that is mounted on the back side of the base structure.

The base structure 11 is provided with a substantially horizontal top panel 14 over which are driven the top runs of a pair of transversely-spaced, endless, carton-transporting belts 15 (individually identified as 15*a* and 15*b*). Above the base top panel 14 is supported a pair of longitudinally-extending carton-clamping and transversely-spaced side rails, (one of which, i.e., 16 is shown in FIGS. 1 and 4), with each suitably supported by upstanding arms, (those for rail 16 being indicated at 17), that are free to be moved transversely in slots in this top panel by equipment within the base structure which will cause the side rails to move alternatively and simultaneously toward and away from each other. Such side rail driving equipment may be any suitable powered means and preferably can be a pneumatic cylinder motor connected to the support structure of one of these side rails for moving it inward and outward sideways, and with the opposed side rail support structure being connected thereto by suitable linkage.

The entrance end 18 of the base structure may be preceded by a suitable roller table on which an attendant may rest an empty carton with its bottom end flaps and side flaps folded inwardly for closure thereof to allow such attendant to load the carton chamber and then infold the top end flaps and side flaps for provision of a loaded and closed carton, as is indicated at 20, all in well-known manner.

Between the laterally-spaced top runs of the pair of transportion belts 15 the central zone of the machine bed 11 is cut away or provided with a longitudinal slot into which a tape applying mechanism assembly or cartridge 21 is inserted downward for suitable detachable anchorage in a position to expose above the top panel 14 its plurality, e.g., three cylindrical wipe-on or applicator rollers 22, 23, and 24 for successive engagement by the loaded carton 20 as it is transported forward by the endless transporting belts 15.

A hinged end panel 31 which is carried by the approach end of the head beam 112 will be abutted by the leading end wall of the oncoming carton 20 for manipulation of a pneumatic valve (131 of FIG. 4) for causing the head beam to be raised clear of the top of each oncoming carton until this control 31 is freed for stopping the rise of the head beam at the top of such forwardly traveling carton. In this manner the head beam is cleared from the path of the oncoming carton and is then permitted to rest down upon or load the top of such carton during its forward travel so that the manipulative action of the application of the tape drawn from its supply roll 32, to the leading and trailing end walls and the bottom of the carton by the tape applying rollers 22, 23, and 24 will not cause any portion of the carton to rise from the transport belts 15 and interfere with the proper application of the tape. This raising of the head beam 112 is effected by suitable pneumatic means in the machine base and support column 13 for suitable adjustment of the elevation of such head beam by its supporting bracket 312.

It will also be noted that the head beam 112 supports an inverted substantial duplicate of the tape applying mechanism cartridge 21, with the tape supply in also the form of a roll which is supported by a suitable upstanding arm 133 that is mounted to the cartridge internally of the head beam 112.

Figure 2:
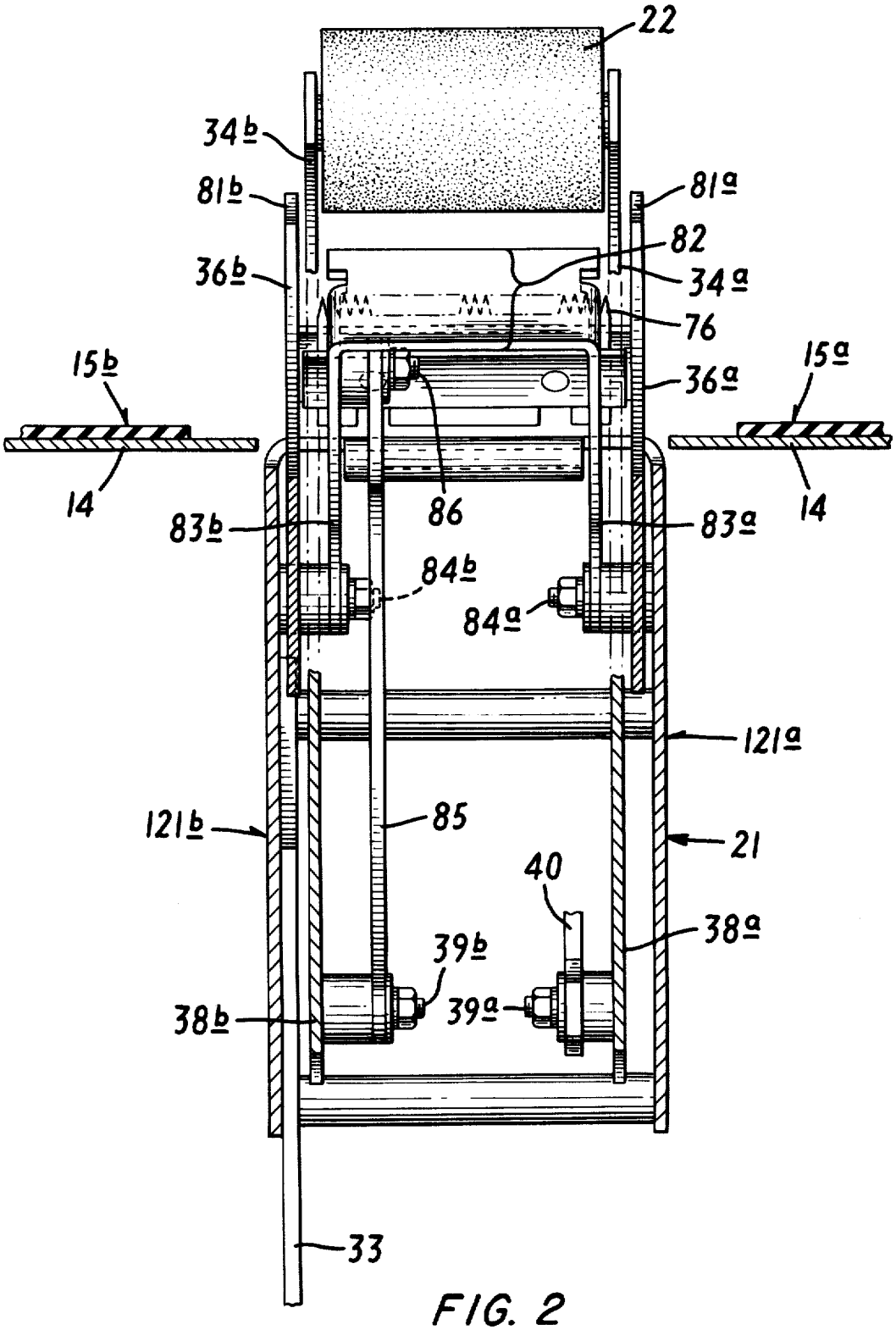
FIG. 2 is a vertical sectional view, with parts broken away, taken substantially on line 2—2 of FIG. 1.

As will be seen from FIGS. 1 and 2 the first tape applicator roller 22 is pivotally carried by a pair of transversely-spaced pivoted arms 34 (individually identified as **34*a* and 34*b*) that are swingable about an axle shaft 35, which also pivotally supports a pair of transversely-spaced knife-carrying arms 36 (individually identified as 36*a* and 36*b*) that are spring biased by a pair of springs 37 (individually identified as 37*a* and 37*b*) toward an upwardly-extending position of tape severancing with limitation of such upward swing by a stop 148. A depending end 38*a* of one of the roller-supporting arms 34*a* has pivotally mounted thereto at 39*a*, below the shaft 35, a connecting link or coupling rod 40 with the other end of the latter pivotally mounted at 41 to another pair of transversely-spaced arms 42 which are pivotally mounted to a cross-shaft 43 for swing about the latter. The arms 42 rotatably support the second applicator roller 23, and a cross pin 44 extending between lower portions 45 thereof serves as an anchor for one end of a tension spring 46 which has its other end connected at 47 to the coupling rod 40, for biasing the pair of arms 34 (individually identified as 34*a* and 34*b*) which together carry the applicator roller 22 in an upright position determined by stop pin 48.**

The third applicator roller 24 is supported by a pair of transversely-spaced arms 50 which is also pivotally supported on cross shaft 43, and a sear-like spring 51 is looped about this shaft with one of its ends anchored to one of the arms 42 laterally of the pivot at 43 and the other of its ends connected to one of the swinging arms 50 for biasing the two sets of arms 42 and 50 toward each other for close approach of the rollers 23 and 24 relative to each other, with such approaching swing of these two sets of arms toward each other preferably being limited by a stop pin 52 carried by one of the arms 50, all as shown in FIG. 1. In an operative structure of this equipment the spring 51 has been duplicated in laterally spaced relation to the one shown in FIG. 1 for balance biasing of this third roller supporting structure.

Tape in the supply roll 32 will have its end section 70 drafted therefrom by pull effected at the applicator roller 22 when it causes the adhesively coated side thereof to engage the leading end wall of a forwardly traveling carton 20 and the carton moves forward with pull upon this end section 66 of this piece of tape. The section 70 of the tape is drafted progressively from the roll by lap of its uncoated back side against a roller 71 to successive lap of its adhesively coated face against knurled rollers 72 and 73 and up over the guide plate 55 for extension of its end section 66 to the back side of the applicator roll 22, to effect the contact thereof to the leading end wall 75 of the advancing carton.

The movement of the carton forward from the position shown in FIG. 1 provides the draft upon the tape end section 66, first to adhere it to the advancing or leading end wall 75 of the carton, then about the lower transverse corner of the latter, and then back centrally and longitudinally of the bottom of the carton where the infolded side flaps are opposed to each other for lap of edge zones thereof to adhere them snugly together.

The first portion of this tape applicating action is illustrated in FIG. 1 and the next advanced position is illustrated in FIG. 4 wherein it is indicated that the medial portion of the bottom of the carton is advancing over the first applicator roller 22 with attendant engagement of the second applicator roller 23 and the third applicator roller 24 respectively against the first portion of the bottom medial zone of the advancing carton 20 and the leading end wall 75 of this carton. Thereafter, the first applicator roller 22 is freed from contact of the further advancing carton 20 so as to free contact of the applicator roller 22 from its bottom and shortly thereafter the contact of the upwardly spring-biased, transversely-spaced pivoted arms **36*a* and 36*b* which carry the severing knife 76. Upon the back or trailing end 80** of the carton passing the swinging knife 76 with severance of the tape thereat the supporting arms means 34 (which comprises the pair of arms 34*a* and 34*b*) that carry the transverse applicator roller 22 will swing backward from its position in FIG. 4 to the initial upright position, as is illustrated in FIG. 1 for a repeat of the operation.

Just prior to such recocking of the first applicator roller carrying arms structure 34*a* and 34*b* the second applicator roller 23 is swung progressively farther back from its position of FIG. 4 after the mid-zone of the carton bottom has moved farther forward so that the carton trailing back end 80 is substantially located thereabove for immediate release of this second applicator roller. The rearward swing of the first applicator roller supporting arms 34*a* and 34*b* to the upright position of FIG. 1 causes the coupling rod or link 40 to swing the second applicator roller arms 42 forward to the position of FIG. 1 with scissoring approach of the third applicator roller 24 back theretoward. Thus the parts of the tape applicator mechanism are returned to their initial positions for processing, by application of adhesive tape to walls and opposed edges of infolded side flaps of the next oncoming or advancing loaded carton.

In accordance with the present invention, as the tape is pulled up through the cartridge 21 by the advancing carton 20, due to adherence of the tape end 66 to the carton leading end wall 75, this tape travels up over the guide plate 55 immediately preceding this first wipe-on roller 22 for guiding the tape to and lapping its back side against this roller. This roller cylindrical surface smoothes out the tape for substantially flat application to opposed carton surfaces against which this roller is rolled. The drafted tape end 66 is pulled up between the guide plate and the overlying spring loaded fork 63 so that its adhesively coated traveling surface is bowed convexly along its longitudinal mid-zone which is moving forward to the first applicator roller so as to reduce or eliminate any tendency to flop about.

It will be noted that as the bottom 77 of the carton 20 is advancing successively over the rollers 22 and 23, in their positions of FIG. 4, the tip end sections 81*a* and 81*b* of the top edges of the spring-biased, blade-carrying arms 36*a* and 36*b* are shaped to be substantially parallel to the top surfaces of the top runs of the carton advancing belts 15 over which the carton bottom readily may slide while keeping these blade carrying arms depressed without projection above the plane of these top surfaces of the belts. However, it is indicated in FIG. 1 that without a loaded carton advancing over these edge sections of the blade-carrying arms 36*a* and 36*b* such tip ends and the cutter blade 76 project upward appreciably above this plane just below which the lateral upper edges of the sidewalls 121*a* and 121*b* of the tape applying mechanism assembly or cartridge are located. This clearly indicates the danger posed by the sharp cutting edge of such projecting blade when unguarded, i.e., absent a covering guard.

Accordingly, this mechanism of the tape applying assembly as embodied in such a carton sealing machine includes, as an important inventive feature, a retractable guard means 82 protectively covering the cutting edge 76 of cut-off means or a cutter 76 when the latter is in a projecting idle position. As had been explained previously this assembly includes a movable carrier, inclusive of swinging arms 34*a* and 34*b*, which supports tape wipe-on means, e.g., a roller 22, that is located in a path of advance of carton 20 through the machine when this assembly is mounted therein, and it will be retractably moved by such carton advance. It also includes additional shiftable carrier means, inclusive of swinging arms 36*a* and 36*b* that support the cutter 76 for moving thereby its cutting edge across a path of travel of the tape 70 to the advancing carton for severance of the tape as the section of the latter of desired length is applied to the carton. This assembly also includes means to retract this guard means for uncovering the cutter's cutting edge while the carton advances past the tape wipe-on means.

The guard means 82 preferably is carried by swinging arm means, in the form of a pair of laterally spaced arms 83*a* and 83*b* pivotally supported respectively at 84*a* and 84*b* on side plates 121*a* and 121*b* of frame structure of the tape applying mechanism assembly or cartridge 21, and one of these swinging arms 83*b* is suitably linked to the movable carrier means 34*a* and 34*b* which supports the tape wipe-on means, i.e., the roller 22. In a preferred embodiment this pair of swinging arms 83*a* and 83*b* together constitute an elongated lever arm structure of the third class pivotally mounted to the assembly frame structure at coaxial points 84*a* and 84*b* and carrying the guard 82 at a point spaced from those coaxial pivot points, with linking means, e.g., a push-pull link or bar 85, being pivotably connected to this lever arm structure at 86 between those points. The tape wipe-on carrier means, in the form of the roller-supporting arms 34*a* and 34*b*, preferably is in the form of a pivoted lever arm structure carrying this tape wipe-on means or roller 22 at its outer end with this lever arm structure and the guard carrying arm being connected directly together by the linking means. Preferably this linking means is in the form of the single link 85 pivotally connected at spaced points to the guard carrying arm structure, i.e., arm 83*b*, and to the wipe-on arm structure 38*a*, with the latter being a lever arm structure of the first class having its end 38*a* opposite that carrying the wipe-on means 22 being linked to the guard carrying arm structure 83*a* and 83*b*, and with this wipe-on arm being pivotally mounted to the assembly frame structure at a point 35 intermediate this arms ends. It is also preferred that the manipulative tape cutter means be in the form of a lever arm structure 36*a* and 36*b* which carries the cutting edge 76 at one end and is coaxially pivotally and independently mounted at the pivot point 35 of the wipe-on arm to the frame structure while the other end of this cutter arm is connected to the frame structure by resilient biasing means or tension spring 37.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is the novel subjects matter defined in the following claims.

We claim:

1. In a tape applying mechanism assembly of a carton sealing machine including movable tape cut-off means having a cutting edge, retractable guard means protectively covering the cutting edge when the cut-off means is in a projecting idle position, comprising, 1. a movable carrier that supports tape wipe-on means to be located in a path of advance of a carton through the machine and to be retractably moved by such advance;
2. manipulative tape cutter means having a cutting edge and additional movable carrier means supporting said cutter means for motion thereby of its cutting edge across a path of travel of the tape to the advancing carton for severance of the tape as the section of the latter of desired length is applied to the carton;
3. retractable guard means protectively covering the cutting edge when said cutter means is in a projecting idle position intervening successive tape applying actions with said guard means being carried by swinging arm means pivotally supported on frame structure of said tape applying mechanism assembly; and
4. means linking said guard carrying swinging arm means to said movable carrier supporting the tape wipe-on means to retract said guard means for uncovering said cutting edge while the carton advances past the tape wipe-on means.

2. The tape cutter protective guard means as defined in claim 1 characterized by said swinging arm means being in the form of an elongated lever arm of the third class pivotally mounted to said frame structure at one point and carrying said guard means at another point spaced from the pivot point, said linking means being pivotally connected to said lever arm between said points.

3. The tape cutter protective guard means as defined in claim 2 characterized by said tape wipe-on carrier means being a pivoted lever arm carrying said tape wipe-on means at its outer end with this tape wipe-on lever arm and said guard carrying arm being connected directly together by said linking means.

4. The tape cutter protective guard means as defined in claim 3 characterized by said linking means being in the form of a link pivotally connected at spaced points to said guard carrying arm and to said wipe-on arm.

5. The tape cutter protective guard means as defined in claim 4 characterized by said wipe-on arm being a lever arm of the first class with the end opposite that carrying the wipe-on means being linked to said guard carrying arm, and with this wipe-on arm being pivotally mounted to said frame structure at a point intermediate this arms ends.

6. The tape cutter protective guard means as defined in claim 5 characterized by said manipulative tape cutter means being in the form of a lever arm carrying the cutting edge at one end and coaxially pivotally and independently mounted at the pivot point of said wipe-on arm to said frame structure with the other end of said cutter arm being connected to said frame structure by resilient biasing means.

* * * * *